US005350667A

United States Patent [19]

Singer et al.

[11] Patent Number: 5,350,667

[45] Date of Patent: Sep. 27, 1994

[54] PHOTOGRAPHIC ELEMENTS CONTAINING MAGENTA COUPLERS AND PROCESS FOR USING SAME

[75] Inventors: Stephen P. Singer, Spencerport; Paul B. Merkel, Rochester, both of N.Y.; Bernard Arthur J. Clark, Berkshire; Paul Louis R. Stanley, Harrow, both of England

[73] Assignee: Eastman Kodak Company, Rochester, N.Y.

[21] Appl. No.: 79,538

[22] Filed: Jun. 17, 1993

[51] Int. Cl.[5] ..... G03C 7/384

[52] U.S. Cl. ..... 430/387; 430/555

[58] Field of Search ..... 430/555, 387

[56] References Cited

U.S. PATENT DOCUMENTS

| | | | |
|---|---|---|---|
| 4,463,085 | 7/1984 | Mutsui et al. | 430/372 |
| 4,853,319 | 8/1989 | Krishnamurthy et al. | 430/387 |
| 4,994,359 | 2/1991 | Morigaki et al. | 430/551 |
| 5,250,405 | 10/1993 | Merkel et al. | 430/555 |
| 5,256,528 | 10/1993 | Merkel et al. | 430/555 |

*Primary Examiner*—Lee C. Wright
*Attorney, Agent, or Firm*—Arthur E. Kluegel

[57] ABSTRACT

A photographic element contains a light-sensitive silver halide layer having associated therewith a coupler which is a pyrazolone compound with a coupling-off substituent at the -4-position, said compound having the formula:

wherein each $R^1$ is independently a substituted or unsubstituted alkylsulfonyl or arylsulfonyl group; each $R^2$ and $R^3$ is independently a substituent; $R^4$, $R^5$, and $R^6$ are independently hydrogen or substituted or unsubstituted alkyl groups; m and n are independently 0 or 1 but both are not 0; x1 and x2 are independently 0 to 5; and y is 0 to 3; provided that each of $R^3$, $R^4$, $R^5$, and $R^6$ is selected such that the calculated log P of the thiophenol corresponding to the substituent at the 4-position of the pyrazolone is at least 4. The photographic element provides an improved combination of low continued coupling together with a magenta hue exhibiting a long wavelength of maximum absorption.

14 Claims, No Drawings

PHOTOGRAPHIC ELEMENTS CONTAINING MAGENTA COUPLERS AND PROCESS FOR USING SAME

FIELD OF THE INVENTION

This invention relates to photographic elements containing magenta couplers comprising a parent 1-phenyl-3-anilino-pyrazolo-5-one and a phenylthio coupling-off group with both the parent and coupling-off group containing substituents providing enhanced photographic properties such as improved hue, reduced staining due to continued coupling, and increased dye-forming speed and efficiency.

BACKGROUND OF THE INVENTION

The use of magenta couplers comprising 1-phenyl-3-anilino-pyrazoto-5-one couplers containing phenylthio coupling-off groups at the 4-position are well known in the art. See for example U.S. Pat. No. 4,853,319 of Krishnamurthy et al. and other patents cited therein. While elements employing such couplers have provided certain advantages, there remain several shortcomings in photographic elements relying on these types of magenta couplers.

These shortcomings relate to the dye-forming efficiency of the coupler, the speed with which the dye is formed, the dye hue, and the undesirable occurrence of staining during processing.

The hue of the dye obtained upon completion of the coupling reaction is important because it affects the accuracy of color rendition and also impacts the printer's ability to produce an accurate print from the negative produced from the original exposure. The hue of the dye is a function of the compositional make-up of both the parent and the coupling-off group. Both the individual substituents and the combined effect of the different substituents selected can affect the hue. The parent substituents affect hue primarily through their affect on the chromophore of the dye while the coupling-off group substituents have a more indirect effect by influencing the local environment of the dye, particularly when the coupled-off group is not free to diffuse away from the dye and into the hydrophillic phase.

Additionally, staining or nonimagewise coloration of the element is to be avoided. One way that staining can occur is through the phenomenon called continued coupling. Certain couplers are more prone than others to react with oxidized developer that is carried over with the film into the bleach bath. These couplers will then undesirably form dye on a nonimagewise basis causing a magenta stain.

The speed and efficiency with which the dye is formed can present added problems. When a coupler undergoes coupling with a color developer to form a dye, the coupler goes through an intermediate stage wherein the oxidized developer and the coupling-off group are both annexed to the coupler parent. This intermediate is a leuco dye which is uncolored until the coupling reaction is complete. In the ideal photographic element, the intermediate stage is essentially instantaneous so that the process of dye formation is completed during development. The presence of the semi-stable leuco dye can effectively reduce dye density and adversely affect color rendition in the printing step. Moreover, the presence of the semi-stable leuco dye can lead to post processing density increases the extent of which cannot be predicted and this leads to the undesirable situation of having an image which changes with time. Thus, the formation of semi-stable leuco dyes needs to be avoided.

The dye forming efficiency of the coupler is affected by many factors such as the extent to which the parent portion of the coupler is ballasted so as to retain its proper position in the photographic element in order to optimize the image recorded. If the coupler parent is not sufficiently ballasted, it is free to wander both horizontally and vertically during processing thereby adversely affecting both sharpness and color rendition. Moreover, the coupler is susceptible to being washed out of the element entirely and thus contributing no dye density to the image. Therefore, this problem is to be avoided.

While various efforts have been made to provide improved couplers, none have succeeded in solving the foregoing problems.

U.S. Pat. No. 4,463,085 suggests a way to reduce the amount of unwanted staining that occurs during processing. Elements containing 1-phenyl-3-anilino-pyrazolo-5-one or 1-phenyl-3-acylamino-pyrazolo-5-one couplers containing phenylthio or other types of coupling-off groups at the 4-position are employed in combination with certain piperidine compounds in order to prevent such staining. The materials exemplified therein do not provide the desired properties such as diffusion resistance of both the parent and coupling-off group. Compound I-28 has the formula:

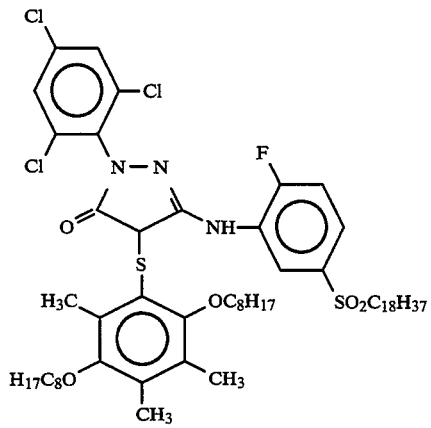

This coupler contains a ballasted parent with a sulfonyl substituent but does not contain a carbonamido substituent in the coupling-off group in a position ortho to the sulfur on the phenyl ring. It does not provide the desired photographic properties in that the presence of the ortho alkoxy substituent on the coupling-off group causes the undesired formation of semi-stable leuco dye which leads to post processing density increases. Research Disclosure 16736, March 1978 discloses parent groups having a hexadecylsulfone in the 4-position of the anilino ring but does not disclose the combination with the coupling-off group of the invention nor the advantages to be obtained thereby.

U.S. Pat. No. 4,994,359 relates to pyrazolone couplers having improved color density and reduced dye staining. These benefits are said to be obtained through the inclusion of a dialkyl amine compound with a pyrazolone coupler having an arylthio coupling-off group which includes a carbonamido substituent in the position ortho to the sulfur. Examples of two of the couplers exemplified (M-4 and M-5) are as follows:

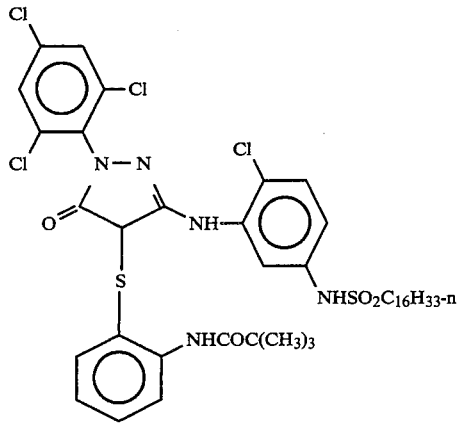

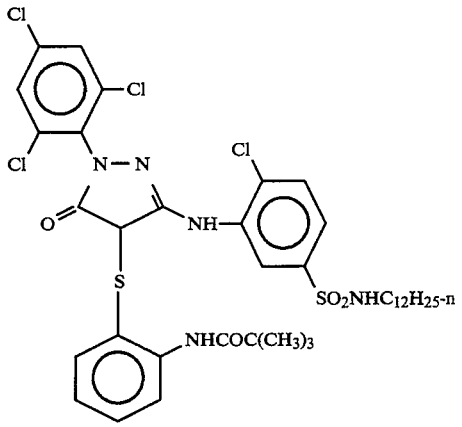

These couplers contain sulfonamide and sulfamoyl substituents, respectively, on the parent anilino groups. For these couplers, the log P of the coupling-off group is inadequate to prevent the undesired wandering of the coupling-off group and corresponding silver development effects. Moreover, the sulfonamide substituent provides inferior properties with respect to hue when compared to the alkyl- or arylsulfonyl substituents of the present invention. U.S. Pat. No. 4,835,319 suggests a coupling-off group having the formula:

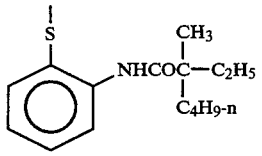

however, it is not suggested to increase the log P and to then employ the coupling-off group with a sulfone containing anilino pyrazolone parent in order to solve the problems of the art.

It is therefore a problem to be solved to provide photographic elements containing a magenta coupler which do not present problems associated with photographic properties such as the dye-forming efficiency of the coupler (including silver development inhibition), the speed with which the dye is formed, the dye hue, and the undesirable occurrence of staining during processing.

SUMMARY OF THE INVENTION

The invention provides a photographic element comprising a light-sensitive silver halide layer having associated therewith a coupler which is a pyrazolone compound with a coupling-off substituent at the -4-position, said compound having the formula:

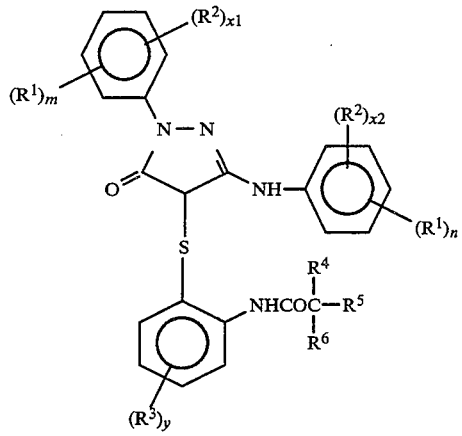

wherein each $R^1$ is independently a substituted or unsubstituted alkylsulfonyl or arylsulfonyl group; each $R^2$ and $R^3$ is independently a substituent; $R^4$, $R^5$, and $R^6$ are independently hydrogen or substituted or unsubstituted alkyl groups; m and n are independently 0 or 1 but both are not 0; x1 and x2 are independently 0 to 5; and y is 0 to 3; provided that each of $R^3$, $R^4$, $R^5$, and $R^6$ is selected such that the calculated log P of the thiophenol corresponding to the substituent at the 4-position of the pyrazolone is at least 4.

The invention also provides a coupler compound and a process for forming images from an exposed element of the type described above through development employing a color development chemical.

The element and process of the invention provide improved photographic properties such as those relating to the dye-forming efficiency of the coupler (including silver development inhibition), the speed with which the dye is formed, the dye hue, and the undesirable occurrence of staining during processing.

DETAILED DESCRIPTION OF THE INVENTION

The invention provides a photographic element comprising a light-sensitive silver halide layer having associated therewith a 1-phenyl-3-anilino-pyrazolo-5one coupler comprising a parent containing an alkylsulfonyl or arylsulfonyl substituent and further having at the 4-position of the pyrazolone ring a coupling-off group comprising a phenylthio group containing a carbonamido substituent in the position ortho to the sulfur on the phenylthio ring with the substituents on the phenylthio ring selected such that the calculated log P of the thiophenol corresponding to the coupling-off group is at least 4.

A photographic element of the invention comprises a light-sensitive silver halide layer having associated therewith a coupler which is a pyrazolone compound having the formula:

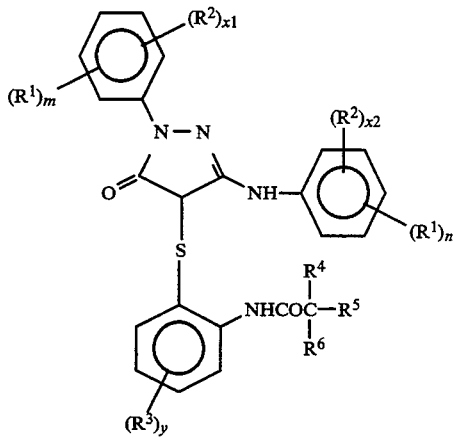

wherein each $R^1$ is independently a substituted or unsubstituted alkylsulfonyl or arylsulfonyl group; each $R^2$ and $R^3$ is independently a substituent; $R^4$, $R^5$, and $R^6$ are independently hydrogen or substituted or unsubstituted alkyl groups; m and n are independently 0 or 1 but both are not 0; x1 and x2 are independently 0 to 5; and y is 0 to 3; provided that each of $R^3$, $R^4$, $R^5$, and $R^6$ is selected such that the calculated log P of the thiophenol corresponding to the substituent at the 4-position of the pyrazolone is at least 4.

$R^1$ may be either an alkyl or aryl sulfonyl group, either of which may be further substituted. While it is possible to have more than one such group on the coupler parent, this is generally unnecessary, particularly where there are other significant electron-withdrawing substituents such as chlorine. Typically, the alkyl or aryl group will contain up to 30 carbon atoms but more are possible where a polymeric coupler is employed as shown in M-9 hereafter. Generally, 24 or less carbon atoms is sufficient.

The parent should contain a ballast group to insure that the dye formed upon coupling stays in place. A ballast group of at least 8 carbon atoms will usually accomplish the desired result. The ballast may be provided as part of $R^1$ or may be included as an $R^2$ substituent.

It is generally preferred to locate the sulfonyl substituent on the anilino ring rather than the N-phenyl ring from the standpoint of manufacturing simplicity and ecological considerations. The 3-, 4-, and 5- positions are preferred. When located on the N-phenyl ring, the position para to the nitrogen attached to the 1-phenyl group is preferred.

The substituents usable for $R^2$ and $R^3$ and, except as otherwise limited, for other indicated substituents herein may be selected from a broad list. They may be, for example, halogen, such as chlorine, bromine or fluorine; nitro; hydroxyl; cyano; carboxyl or its salts; and groups which may be further substituted, such as alkyl, including straight or branched chain alkyl, such as methyl, trifluoromethyl, ethyl, t-butyl, 3-(2,4-di-t-amylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)-butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecyl-pyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyt)carbonylamino, p-dodecylphenylcarbonylamino, p-toluylcarbonylamino, N-methylureido, N,N-dimethylureido, N-methyl-N-dodecylureido, N-hexadecylureido, N, N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido; and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N, N-dimethylsulfamoyl; N-[3-(dodecyloxy)propyl]sulfamoyl, N-[4-(2,4-di-t-pentylphenoxy)-butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyt, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl;; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 30 carbon atoms and usually less than 24 carbon atoms, but greater numbers are possible depending on the particular substituents selected. Moreover, as indicated, the substituents may themselves be suitably substituted with any of the above groups.

The coupling-off group is one comprising a phenylthio group having a certain carbonamido substituent in the position ortho to the sulfur of the arylthio coupling-off group. The carbonamido substituent is one that has only hydrogen or substituted or unsubstituted alkyl groups bonded to the carbon alpha to the acyl carbon of the carbonamido group. Thus, these substituents, designated $R^4$, $R^5$, and $R^6$ may be hydrogen or an alkyl group which may optionally be substituted. Where present, the alkyl group will typically have up to 30 carbon atoms and preferably 24 or less. In one embodiment, the alkyl group or groups are free of alkyl branching (e.g. may contain branching to hetero or acyl atoms but not to alkyl carbon atoms) and may contain two or more of such alkyl groups. The substituents referred to may be as prescribed for $R^2$ and $R^3$ above.

In addition to the limitation of the individual substituents, there is also a need to coselect the substituents $R^3$ through $R^6$ so that the log P of the thiophenol corresponding to the coupling-off group is at least 4, preferably at least 4.5 and more desirably at least 5. The log P referred to herein is the logarithm of the partition coefficient between octanol and water. The photographic element of the invention is a multiphase material and therefore the coupler can distribute itself among the different phases present. The log P indicates the relative solubility of the coupler in the hydrophobic and hydrophilic phases of the element. A compound which partitions equally between the two phases will have a log P of 0. Higher log P values indicate that the compound exhibits increasingly greater hydrophobic properties. Materials with high log P values are essentially confined to the organic phase surrounding the coupler and are not likely to migrate to the hydrophilic gel phase where the light sensitive silver is. This may be particularly important where it is desired to prevent a compound such as a thio coupling-off group from attacking the silver and inhibiting it from developing.

Rather than performing a partition experiment it is a preferred alternative to calculate the log P of a substituent. The log P values are calculated using version 3.54 of the Medchem program, Medicinal Chemistry Project, Pomona College, Claremont, Calif. (1984). (For a discussion of this method see Albert J. Leo, in "Comprehensive Medicinal Chemistry", edited by C. Hansch, P. G. Sammes, and J. B. Taylor, Pergamon Press, New York, Volume 4, 1990 and U.S. Pat. No. 4,782,012.) Values for estimating the log P (or pi) of a substituent are shown in the above mentioned article of C. Hansch and A. J. Leo, in "Substituent Constants for Correlation Analysis in Chemisty and Biology", Wiley, New York, 1979).

In a most preferred embodiment, the coupler has the formula with the substituents as previously defined:

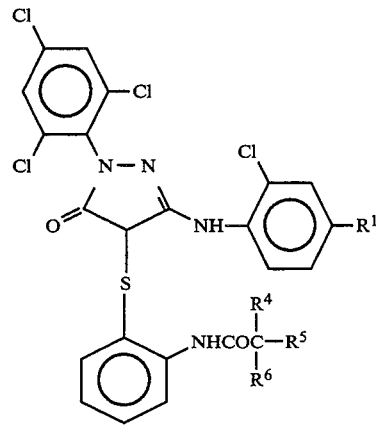

Specific examples of couplers suitable for use in the invention are as follows:

Coupler Parents (Q = Coupling-off group)

M-1

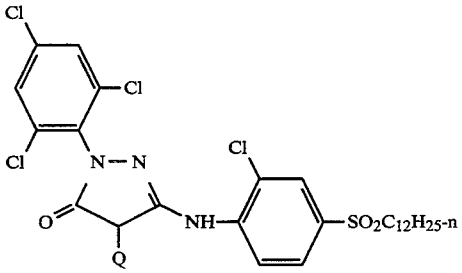

M-2

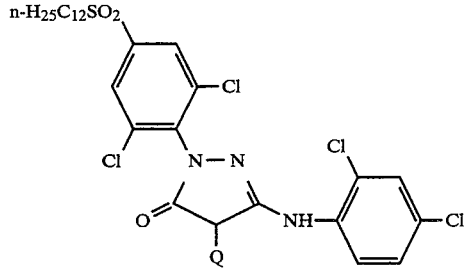

-continued
M-3
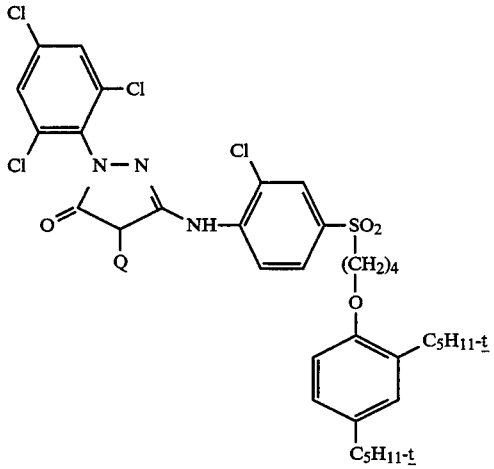
M-4
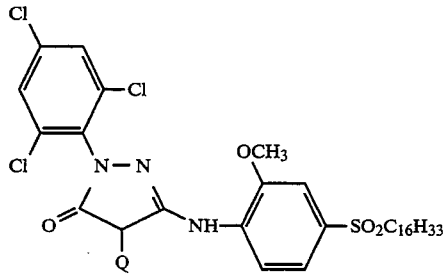
M-5
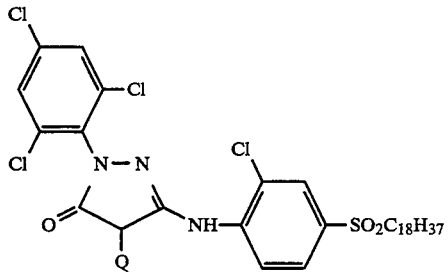
M-6
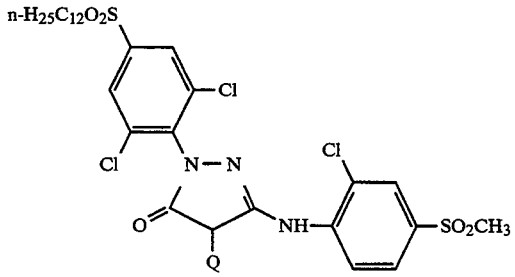
M-7
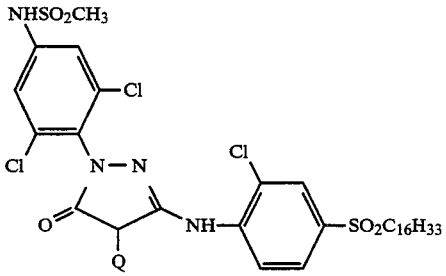
M-8
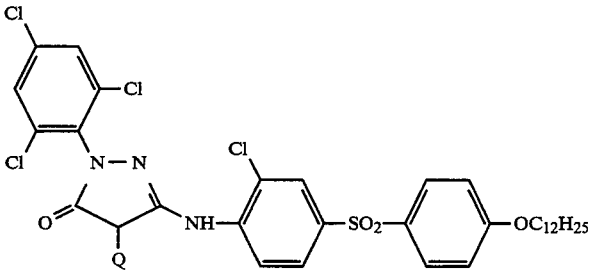
M-9
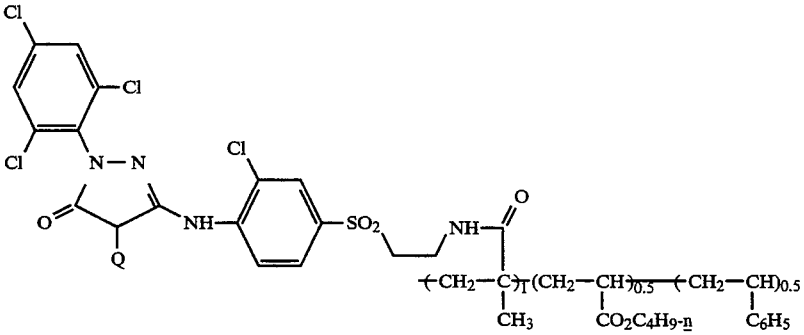
Coupler coupling-off groups -continued
Q-1
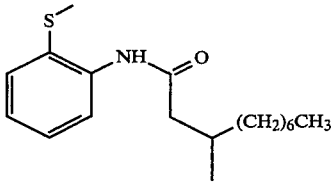
Q-2
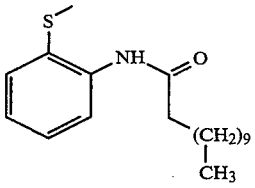
Q-3
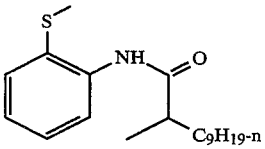
Q-4
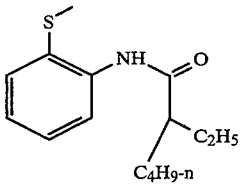
Q-5
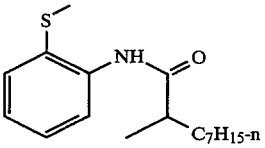
Q-6
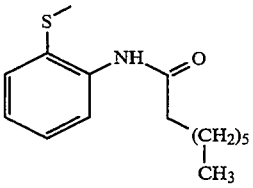
Q-7
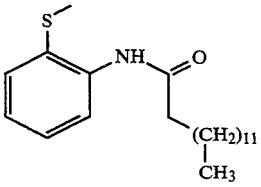
Q-8
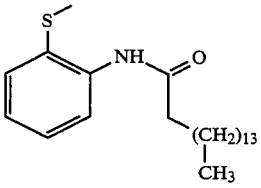
Q-9
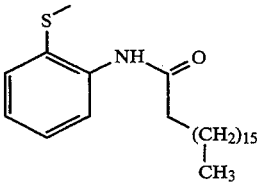
Q-10
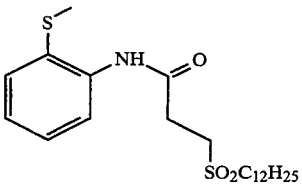
Q-11
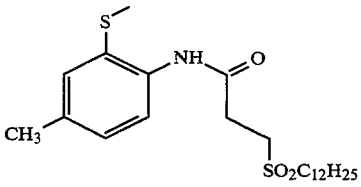
Q-12
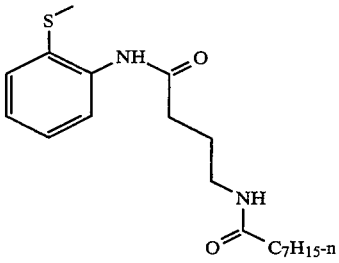
Q-13
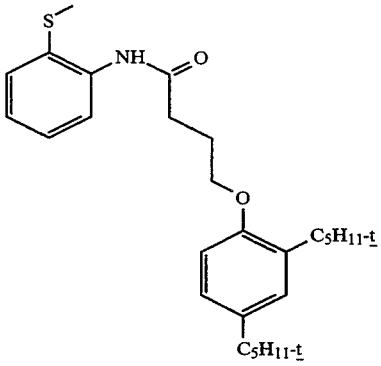
Q-14
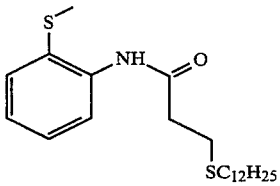

-continued

Q-15

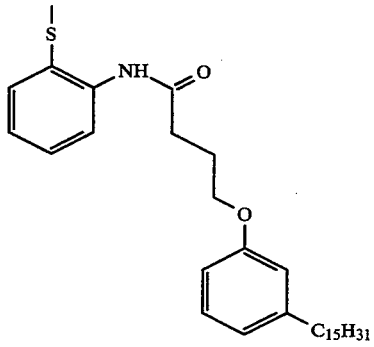

Q-16

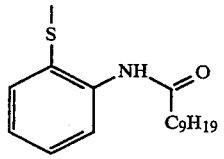

Q-17

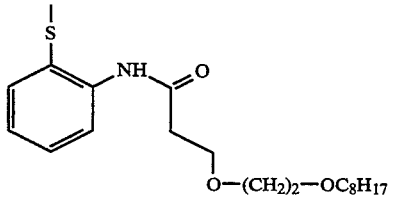

The materials of the invention can be used in any of the ways and in any of the combinations in which such compositions are used in the photographic art. Typically, they are incorporated in a silver halide emulsion containing layer and the layer coated on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the coupler is in the silver halide emulsion layer or in an adjacent location where, during processing, the compositions are capable of reacting with silver halide development products.

Representative ballast groups include substituted or unsubstituted alkyl or aryl groups containing 7 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 40 carbon atoms. Such substituents can also be further substituted.

The photographic elements can be single color elements or multicolor elements. Multicolor elements contain dye image-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

For example, the coupler of the invention may be used to replace all or part of the image coupler or may be added to one or more of the other layers in a color negative photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl-)amino)-, dodecyl ester and a slow yellow layer containing the same compound together with "Coupler 2": Propanoic acid, 2-[[5-[[4-[2-[[[2,4-bis(1,1-dimethyl propyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-,"Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-((( 3-(dodecyloxy)propyl)amino)carbonyl)-5-hydroxy-1-naphthalenyl)-, 2-methylpropyl ester, "Coupler 7": Acetic acid, ((2-((3-(((3-(dodecyloxy)propyl-)amino) carbonyl)-4-hydroxy-8-(((2-methylpropoxy)-carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)-phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the coupler of the invention may suitably be used to replace all or a part of the image coupler or added to a layer in a photographic element such as one comprising a support bearing the following from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-;Phenol, 2-(2H-benzotriazol-2-yl)-4-(1,1-dimethylethyl)-;Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2', 3,3'-tetrahydro-3,3,3', 3'-tetramethyl-5,5', 6,6'-tetrapropoxy-;

(5) an interlayer; and (6) a yellow layer sonraining "Coupler 4": 1-Imidazolidineacetamide, N-(5-((2-(2,4-bis(1,1-dimethylpropyl)phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal medium, the coupler of the invention could be used to replace all or part of the image coupler or added to a layer in a photographic element such as one comprising a support and bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2', 3,3'-tetrahydro-3,3,3', 3'-tetramethyl-5,5', 6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl-)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

The invention materials herein may be used in combination with photographic compounds such as those based on 3-acylamino- and 3-anilino- 5-pyrazolones (other than those of the invention) and heterocyclic couplers (e.g. pyrazoloazotes) such as those described in EP 285,274; U.S. Pat. No. 4,540,654; EP 119,860, which may contain different ballasts or coupling-off groups such as those described in U.S. Pat. No. 4,301,235; U.S. Pat. No. 4,853,319 and U.S. Pat. No. 4,351,897. They may also be used in association with yellow or cyan colored couplers (e.g. to adjust levels of interlayer correction) and, in color-negative applications, with masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

With regard to the inclusion of other couplers in the element, the presence of certain coupling-off groups is well known in the art. Such groups can determine the chemical equivalency of the coupler, i.e., whether it is a 2-equivalent or a 4equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group provides a 2-equivalent coupler. Representative classes of such coupling-off groups include, for example, chloro, alkoxy, aryloxy, heterooxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

The invention materials may also be used in association with materials that accelerate or otherwise modify the processing steps e.g. of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anticolor-mixing agents such as derivatives of hydroquinones, aminophenols, amines, gallic acid; catechot; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the materials of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 72,573; 335,319; 336,411; 346, 899; 362,870; 365,252; 65,346; 373,382; 376,212; 377,463; 378,236; 384,670; 96,486; 401,612; 401,613.

Such compounds are also disclosed in "Developer-Inhibitor-Releasing (DIR) Couplers for Color Photography," C. R. Bart, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moleties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazotes, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

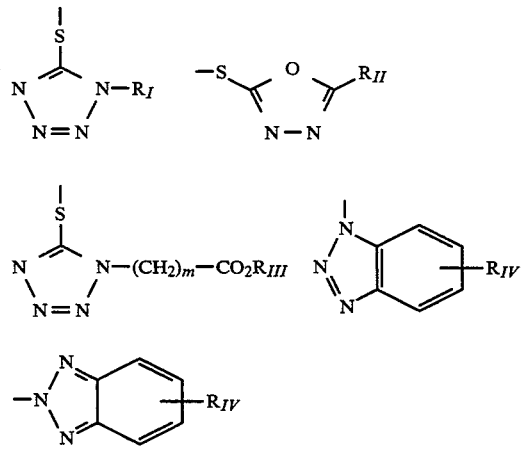

wherein $R_I$ is selected from the group consisting of straight and branched alkyls and alkoxy typically of from 1 to about 8 carbon atoms, benzyl and phenyl groups and said groups containing none, one, or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

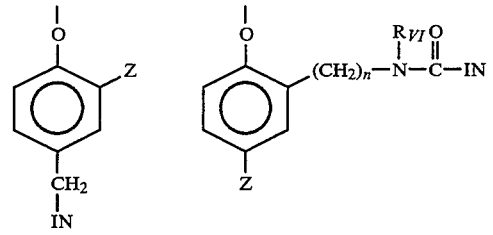

wherein IN is the inhibitor moiety, Z is selected from the group consisting of nitro, cyano, alkylsulfonyl; sulfamoyl (—$SO_2NR_2$); and sulfonamido (-$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

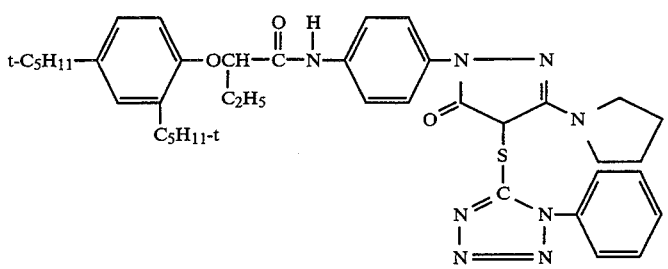

D2

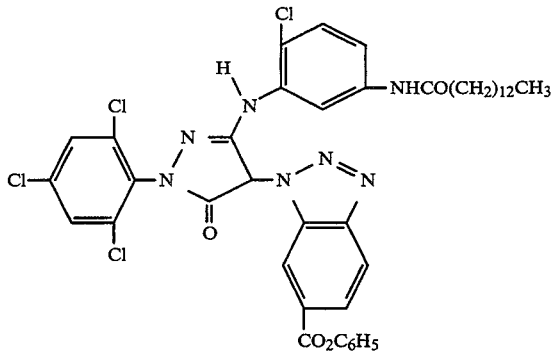

-continued
D3
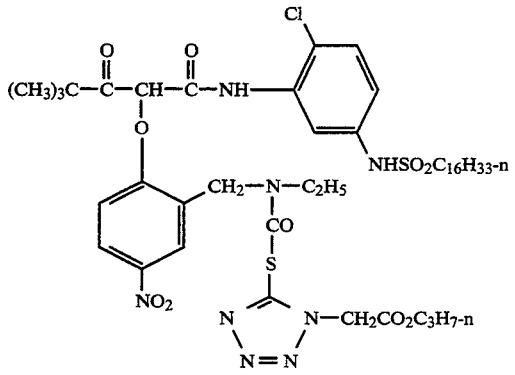
D4
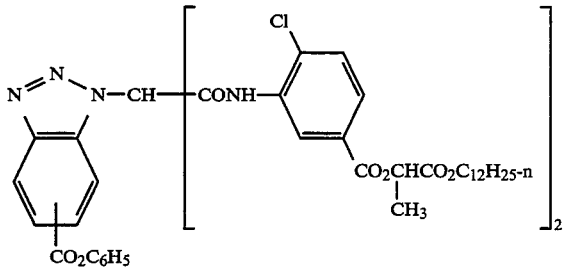
D5
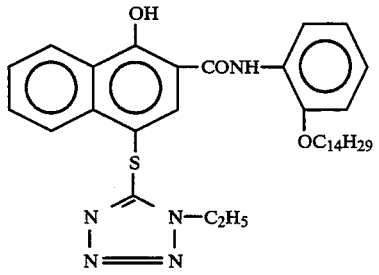
D6
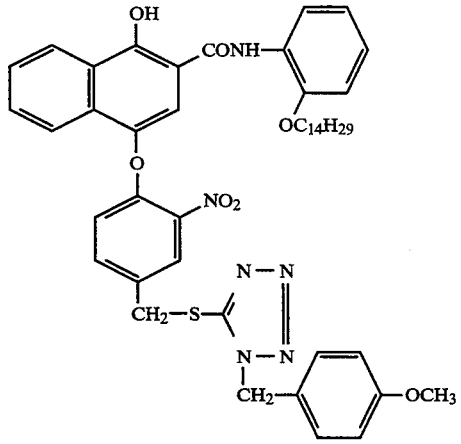

-continued

D-7

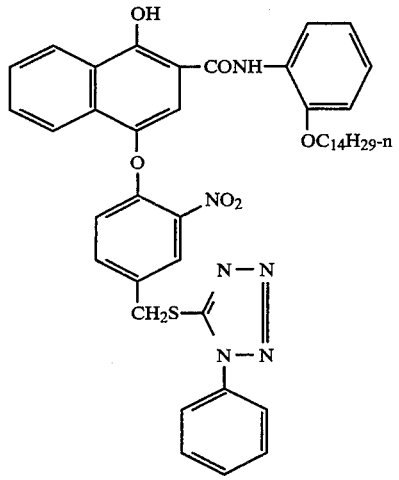

D-8

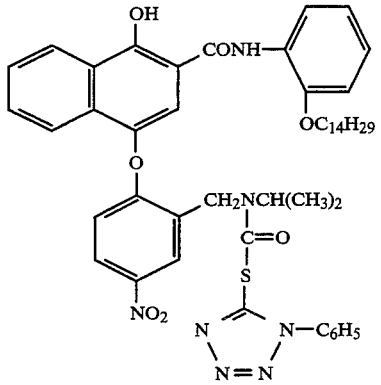

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in combination with the invention are disclosed in Japanese Published Applications having the following Derwent Abstract Accession Numbers: 83-09,959; 83-62,586; 90-072,629, 90-072,630; 90-072,632; 90-072,633; 90-072,634; 90-077, 822; 90-078,229; 90-078,230; 90-079,336; 90-079, 338; 90-079,690; 90-079,691; 90-080,487; 90-080, 489; 90-080,490; 90-080,491; 90-080,492; 90-080, 494; 90-085,928; 90-086,669; 90-086,670; 90-087, 361; 90-087,362; 90-087,363; 90-087,364; 90-088, 096; 90-088,097; 90-093,662; 90-093,663; 90- 094,055; 90-094,056; 90-101,937; 90-103,409; 90-151,577.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabutarity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometers) tabular grains. To achieve the lowest levels of granularity it is preferred that aim tabular grain projected areas be satisfied with ultrathin ($t<0.06$ micrometers) tabular grains. Tabular grain thicknesses typically range down to about 0.02 micrometers. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometers.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Hason Publications, Ltd., Emsworth, Hampshire P010 7DD, England; U.S. Pat. Nos. 4,439,520; 4,414,310; 4,433,048; 4,643,966; 4,647,525; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. The described elements are optionally processed in the known color processes for processing color print papers, such as the known RA-4 process of Eastman Kodak Company and as described in the British Journal of Photography Annual of 1988, pages 198–199. To provide a positive (or reversal) image, the color development step can be preceded by development with a non-chromogenic developing agent to develop exposed silver halide, but not form dye, followed by uniformly fogging the element to render unexposed silver halide developable. Alternatively, a direct positive emulsion can be employed to obtain a positive image.

Preferred color developing agents are p-phenylenediamines. Especially preferred are:

4-amino-N,N-diethylanitine hydrochloride, 4-amino-3-methyl-N,N-diethylaniline hydrochloride, 4-amino-3-methyl-N-ethyl-N-(β-(methanesutfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms.

The scope of the invention encompasses not only the photographic element but also the coupler compound itself as well as the process of forming an image from the described photographic element with a color developing solution as described.

Synthetic Example

The following Scheme A outlines a method for the preparation of a coupler of the invention:

SYNTHETIC SCHEME A

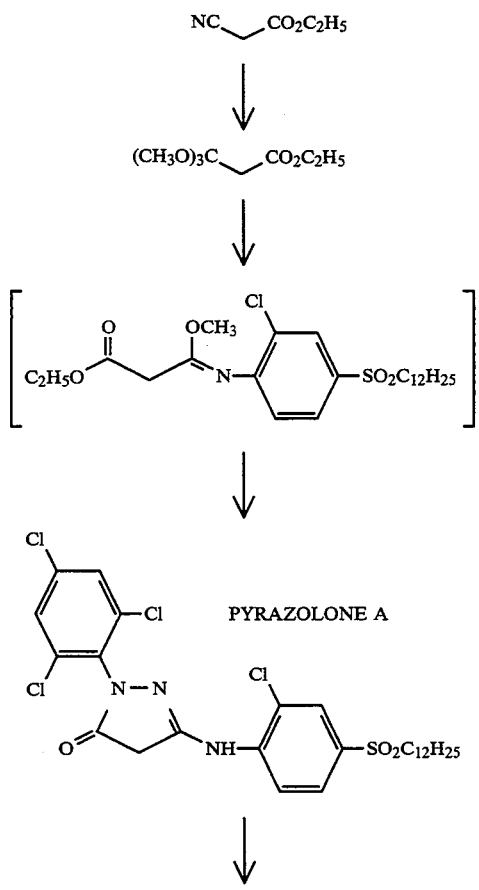

-continued

SYNTHETIC SCHEME A

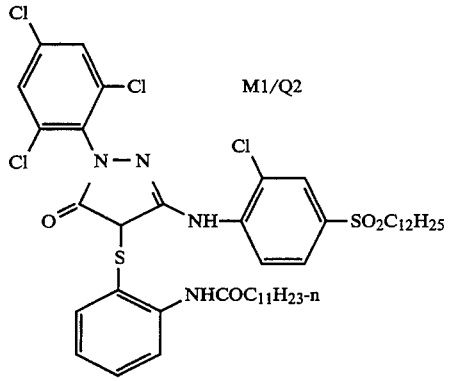

Preparation of Ethyl-3-ethoxy-3-iminopropionate hydrochloride

Hydrogen chloride gas was bubbled through a stirred solution of ethyl cyanoacetate (900 g, 7.96 moles), ethanol (410 ml, 7.0 moles) and diethyl ether (2.4 liters). The temperature was kept at <15° C. by use of a cooling bath. After 3.5 hours 395 g (10.8 moles) of HCl had been absorbed. The flask was kept in the cold room over the weekend. The crystalline white product was filtered off, washed with diethyl ether, then petroleum ether and dried under vacuum. The yield was 1210 g (88% ).

Preparation of Ethyl-3,3,3-trimethoxypropionate

Ethyl-3-ethoxy-3-iminopropionate hydrochloride (1.21 kg, 6.19 moles) was stirred with methanol (3 liters) at room temperature overnight. The precipitated ammonium chloride was filtered off and most of the methanol was removed on the rotavapor. The residue was treated with diethyl ether (1.5 liters) and washed with water (1.5 liters) followed by 2×1.5 liters of 10% sodium carbonate solution. The first sodium carbonate wash removed some yellow color. The ether layer was separated, dried ($MgSO_4$) and the solvent removed on the rotavapor to give a colorless liquid. The yield was 867 g (73%). The structure of the product was confirmed by NMR and IR spectroscopy.

Preparation of Pyrazolone A

A mixture of ethyl-3,3,3-trimethoxypropionate (35 g, 0.18 moles), 2-chloro-4-dodecylsulphonylaniline (54 g, 0.15 moles), p-toluenesulphonic acid (0.3 g) and toluene (300 ml) was stirred and heated. When the temperature had reached 60° C., concentrated sulphuric acid (18 drops) was added. When the temperature reached 70° C., solvent started to distil over. The temperature of distillation rose from 70° C. to 112° C. Heating was continued at 112° C. for 15 minutes when 150 ml of solvent had distilled over. TLC showed about 10% of starting aniline was still present. A further 3 g of the orthoester and 0.2 g of p-toluenesulphonic acid were added along with more toluene (200 ml). Heating was continued for 20 minutes while distilling another 100 ml of solvent. TLC now showed a major spot with only a trace of the starting aniline. The solvent was removed on the rotavapor to give an oil (81 g). This was dissolved in acetic acid (230 ml) and 2,4,6-trichlorophenylhydrazine (30.67 g, 0.145 moles) was added. The resultant slurry was stirred at room temperature. After 2 hours a solution was obtained. The reaction mixture was stirred overnight at room temperature until it had set solid. It was transferred to a rotavapor flask using warm petroleum ether and the solvents removed to give a red oil (133 g). This oil was transferred to a 3-necked flash using methanol (380 ml) and a solution of potassium hydroxide (42 g, 0.75 moles) in methanol (230 ml) added with good stirring and ice-bath cooling over 10 minutes at >20° C. The resultant dark red solution was stirred at 15°-20° C. for 10 minutes and then acetic acid (44 ml) was added. The precipitated oil soon crystallized. The mixture was stirred at room temperature for 1.5 hours and the solid filtered off, washed with methanol and then recrystallized from acetic acid (280 ml). When the hot acetic acid solution had cooled to 35° C., methanol (550 ml) was added, the mixture stirred at 10° C. for 1 hour, filtered, washed with methanol and dried. The yield was 65.1 g (72.3%). Hplc—100%.

Calc. C, 51.85; H, 5.50; Cl, 22.97; N, 6.69; S, 5.09.
Found C, 52.18; H, 5.35; Cl, 22.82; N, 6.76; S, 5.16.

Preparation of bis-2,2'-undecylcarbonamidophenyl disulfide

Lauroyl chloride (22.9 g, 105 mmole) was added to a solution of aniline disulfide (12.4 g, 50 mmole) in THF (100 ml) and pyridine {20 ml) at 20°-25° C. over ½ hour. A thick precipitate was formed. The suspension was stirred at room temperature for one hour and then added portionwise to stirred 3N hydrochloric acid (1500 ml). The solid was collected by filtration, washed well with water, and dried in a vacuum oven at 40° C. The product, a white colored solid, gave 30.6 g (100%).

Elemental Analysis

Requires C, 70.54; H, 9.21; N, 4.57; S, 10.46. Found C, 69.92; H, 9.53; N, 4.30; S, 9.95 69.91; 9.54; 4.29

Preparation of Coupler M1/O2

Sulphuryl chloride (2.4 g, 18 mmole) was added to a suspension of bis-2,2'-undecylcarbonamidophenyl disulfide (11 g, 18 mmole) in dichloromethane (75 ml) and stirred at room temperature for 2 hours. The volatiles were removed by rotary evaporation below 40° C. A solution of pyrazolone A (20 g, 32.2 mmole) in DMF (50 ml) was added to the solid and stirring at room temperature continued for 116 hours. The suspension was slowly poured into 3N hydrochloric acid (750 ml) and the resulting aqueous phase decanted off. The residue was dissolved in ethyl acetate (250 ml) and the organic solution washed with water (2×100 ml), dried, and evaporated under reduced pressure. The crude material was purified by column chromatography, eluting with 4:1 pet:EtOAc. The residue was dissolved in acetic acid (100 ml) and dripped slowly into water (1000 ml). The solid was collected by filtration and washed well with water, to give product as a white solid, 23.0 g (77%).

Elemental Analysis

Requires C, 58.31; H, 6.53; Cl, I5.30; N, 6.05; S, 6.92
Found C, 58.52; H, 6.65; Cl, 15.23; N, 6.04; S, 6.61

Photographic Examples

The following Tables illustrate the advantages of the invention. The formulas for the couplers used are shown in column 2 of the tables with reference to the parent and coupling-off groups (COG) shown in the detailed description. The coupler solvents S1 and S2 are shown following the tables. For all of the samples, photographic elements were prepared by coating a cellulose acetate-butyrate film support (with a rem-jet antihalation backing) with a photosensitive layer containing a silver bromoiodide emulsion at 1.08 g/m$^2$, gelatin at 3.77 g/m$^2$ and an image coupler dispersed in the indicated coupler solvent at 0.52 mmoles/m$^2$ (weight ratio coupler:solvent:stabilizer ST1=1.:0.8:0.2.) The photosensitive layer was overcoated with a layer containing gelatin at 2.69 g/m$^2$ and bis-vinylsulfonyl methyl ether hardher at 1.75 weight percent based on total gel.

Samples of each element were exposed imagewise through a stepped density test object and subjected to the Kodak Flexicolor C-41 process as described in *British Journal of Photography Annual,* 1988, pp. 196–198.

Thus treated samples were then subjected to tests to evaluate the photographic properties of the elements as follows:

"ΔDmin pH6" was determined by subtracting (1) the minimum density when a 1% sulfuric acid stop bath is utilized after the development process from (2) the minimum density obtained when no stop bath and a bleach bath seasoned to pH value of 6 is utilized. This result is a measure of continued coupling which causes an undesired nonimagewise stain. Lower numbers are better since that indicates less stain resulting in the standard unstopped process.

$\lambda_{max}$ signifies the wavelength of maximum light absorption in nanometers (nm) of the dye formed upon coupling with oxidized developer.

The results of testing are shown in Tables I and II where inventive and comparison samples are grouped for ready comparison.

TABLE I

Continued Coupling and Hue - Solvent S1

| Sample | Coupler Parent/ COG | Invention(I)/ Comparison(C) | ΔDmin pH6 | λmax (nm) | Feature |
|---|---|---|---|---|---|
| 1 | M1/CQ1 | C | .149 | 545 | $R^4$ = phenoxy |
| 2 | M1/CQ2 | C | .251 | 545 | " |
| 3 | CM2/Q2 | C | .088 | 537 | No sulfone |
| 4 | CM3/Q2 | C | .171 | 544 | Sulfamoyl |
| 5 | M1/Q2 | I | .014 | 546 | Inv |
| 6 | M1/Q3 | I | .081 | 545 | Inv |
| 7 | M1/Q3 | I | .091 | 545 | Inv |

TABLE II

Continued Coupling and Hue - Solvent S2

| Sample | Coupler Parent/COG | Invention(I)/Comparison(C) | ΔDmin pH6 | λmax (nm) | Feature |
|---|---|---|---|---|---|
| 8 | CM1/CQ1 | C | .117 | 543 | No sulfone/$R^4$ = phenoxy |
| 9 | CM2/Q2 | C | .211 | 540 | No sulfone |
| 10 | M1/Q1 | I | .200 | 549 | Inv |
| 11 | M1/Q2 | I | .220 | 548 | Inv |
| 12 | M1/Q3 | I | .161 | 549 | Inv |
| 13 | M1/Q4 | I | .167 | 549 | Inv |

S1 n-$C_{11}H_{23}CON(C_4H_9\text{-}n)_2$

S2

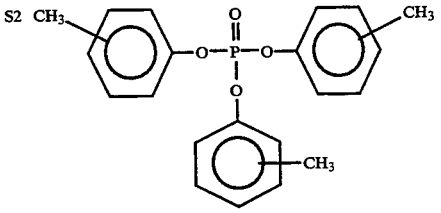

ST1

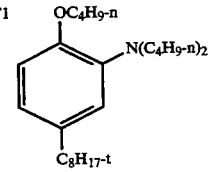

only when the requirements of the invention are satisfied. Thus, in Table I, The ΔDmin values for Samples 1,2, and 4 are from 50 to 150 percent higher than those for Samples 5 to 7. In the case of Sample 3, the hue is shifted hypsochromically with a λmax that is 8 or 9 nanometers shorter than for inventive samples 5 to 7. In Table II, the hue is also deficient for the comparison Samples 8 and 9 where the λmax is from 5 to 9 nanometers shorter than for the invention.

The invention has been described in detail with particular reference to preferred embodiments thereof, but it will be understood that the invention includes variations and modifications within the spirit and scope of the invention.

What is claimed is:

1. A photographic element comprising a light-sensitive silver halide layer having associated therewith a coupler which is a pyrazolone compound with a coupling-off substituent at the -4-position, said compound having the formula:

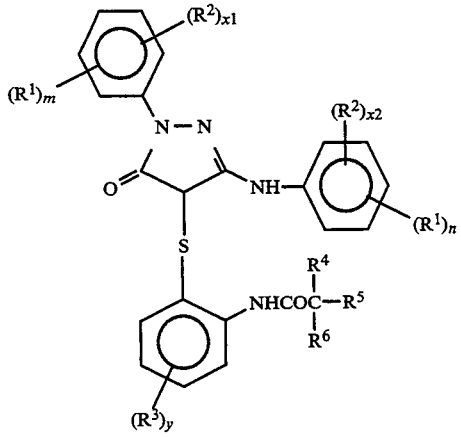

wherein each $R^1$ is independently a substituted or unsubstituted alkylsulfonyl or arylsulfonyl group; each $R^2$ and $R^3$ is independently a substituent; $R^4$, $R^5$, and $R^6$ are independently hydrogen or substituted or unsubstituted alkyl groups; m and n are independently 0 or 1 but both are not 0; x1 and x2 are independently 0 to 5; and y is 0 to 3; provided that each of $R^3$, $R^4$, $R^5$, and $R^6$ is selected The test results in both tables demonstrate that the desired levels of low stain (ΔDmin) and long wavelength of maximum absorbance (λmax) are achieved such that the calculated log P of the thiophenol corresponding to the substituent at the 4-position of the pyrazolone is at least 4.

2. The element of claim 1 wherein n is 1 and $R^1$ is at the 4- or 5- position of the anilino ring.

3. The element of claim 1 wherein each of $R_3$, $R^4$, $R^5$, and $R^6$ is selected such that the calculated log P of the corresponding thiophenol is at least 4.5.

4. The element of claim 1 wherein $R^1$ is a substituted or unsubstituted alkylsulfonyl and n is 1.

5. The element of claim 1 wherein $R^1$ is a substituted or unsubstituted alkylsulfonyl, m is 1 and $R^1$ is located para to the nitrogen attached to the 1-phenyl group.

6. The element of claim 1 wherein at least one of $R^4$, $R^5$, and $R^6$ is a substituted or unsubstituted alkyl group.

7. The element of claim 6 wherein said at least one alkyl group is free of alkyl branching.

8. The element of claim 6 wherein at least two of $R^4$, $R^5$, and $R^6$ is a substituted or unsubstituted alkyl group.

9. The element of claim 1 wherein the coupler has the formula:

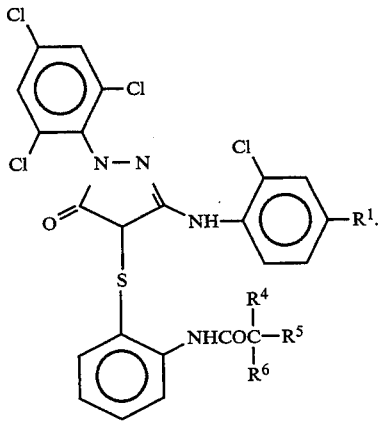

wherein $R^1$ is a substituted or unsubstituted alkylsulfonyl group in which the alkyl group contains from 5 to 30 carbon atoms and wherein $R^4$, $R^5$, and $R^6$ are independently hydrogen or substituted or unsubstituted alkyl groups.

10. The element of claim 9 wherein $R^1$ includes a ballast group.

11. The element of claim 9 wherein $R^1$ contains an unsubstituted alkyl group.

12. The element of claim 1 wherein the coupler is represented by the formula:

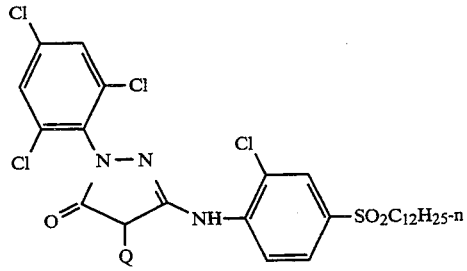

wherein Q is a coupling-off group selected from the group consisting of:

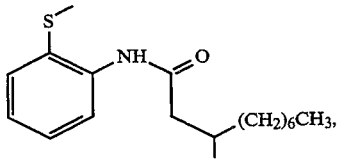

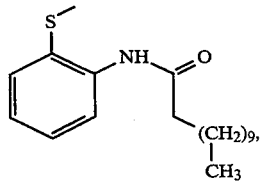

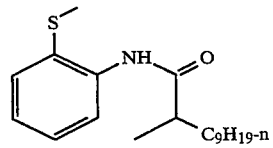

and

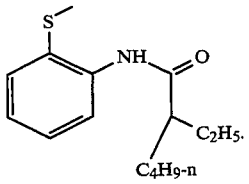

13. A process of forming an image comprising contacting an exposed element as described in claim 1 with a color developing chemical.

14. A process of forming an image comprising contacting an exposed element as described in claim 9 with a color developing chemical.

* * * * *